US006059287A

United States Patent [19]

Bae

[11] Patent Number: 6,059,287

[45] Date of Patent: May 9, 2000

[54] PAPER DISCHARGE APPARATUS OF PRINTER

[75] Inventor: Sang-Jin Bae, Kyungki-do, Rep. of Korea

[73] Assignee: SamSung Electronics Co., Ltd., Kyungki-do, Rep. of Korea

[21] Appl. No.: 08/805,385

[22] Filed: Feb. 24, 1997

[30] Foreign Application Priority Data

Feb. 24, 1996 [KR] Rep. of Korea ..... 96-2893

[51] Int. Cl.[7] ..... B65H 29/20

[52] U.S. Cl. ..... 271/315; 271/314; 271/272

[58] Field of Search ..... 271/314, 272–4

[56] References Cited

U.S. PATENT DOCUMENTS

| | | | |
|---|---|---|---|
| 4,163,550 | 8/1979 | Armstrong | 271/274 |
| 4,170,350 | 10/1979 | Conti | 271/274 |
| 4,335,950 | 6/1982 | Gunzelmann et al. | 271/273 X |
| 4,496,339 | 1/1985 | Moll | 271/274 X |

FOREIGN PATENT DOCUMENTS

| | | | |
|---|---|---|---|
| 0239317 | 9/1987 | European Pat. Off. | 271/274 |
| 000472893 | 3/1992 | European Pat. Off. | 271/274 |
| 0110470 | 4/1989 | Japan | 271/314 |
| 0271351 | 10/1989 | Japan | 271/314 |
| 405186121 | 7/1993 | Japan | 271/314 |
| 406016274 | 1/1994 | Japan | 271/274 |
| 406032509 | 2/1994 | Japan | 271/314 |

*Primary Examiner*—Robert P. Olszewski
*Assistant Examiner*—Steven B. McAllister
*Attorney, Agent, or Firm*—Robert E. Bushnell, Esq.

[57] ABSTRACT

The present invention relates to an improved paper discharge apparatus of a printer having a star wheel over a paper discharge roller, separated from a paper discharge part in order to perform an amicable paper discharge function, thereby preventing the blur of ink on paper. The apparatus comprises a paper discharge roller for imparting the discharge force to a sheet of paper printed, a star wheel for imparting the force of press required for the paper discharge at the upper portion of the paper discharge roller, a spring line whose both ends are fixed at a base frame by a fixing means, the spring line supporting the star wheel and functioning as a shaft which is able to make the star wheel rotate, and a wheel frame having a wheel location guide, the wheel location guide being fixed at the base frame for supporting the spring line at its regular location, and preventing the location movement of the star wheel.

16 Claims, 6 Drawing Sheets

PAPER DISCHARGE APPARATUS OF PRINTER

CLAIM OF PRIORITY

This application makes reference to, incorporates the same herein, and claims all benefits accruing under 35 U.S.C §119 from an application entitled *Paper Delivery Apparatus of Printer* earlier filed in the Korean Industrial Property Office on Feb. 24, 1996, and there duly assigned Serial No. 96-2893 by that Office.

BACKGROUND OF THE INVENTION

1. Field of the Invention

The present invention relates to a paper discharge apparatus of a printer such as an ink-jet printer, for discharging printed paper, and more particularly, to an improved paper discharge apparatus having a star wheel over a paper discharge roller, separated from a paper discharge part in order to perform an amicable paper discharge function, thereby preventing the blur of ink on paper.

2. Discussion of Related Art

A general ink-jet printer comprises a paper supply part for supplying paper one by one; a paper convey part with a convey roller and a friction roller for conveying the paper supplied by the paper supply part in accordance with convey instructions; a print part having a timing belt, a guide shaft, a carriage moving right and left by the force of convey of the timing belt and the guidance of the guide shaft in order that an ink may be ejected and printed on the paper conveyed by the paper convey part, and an ink cartridge moving by the carriage for printing the ink on the paper in accordance with print instructions; and a paper discharge part with a paper discharge roller and a star wheel for discharging the paper printed by the print part. A paper discharge part concerned with the present invention will be described in detail hereinafter. Preferably, the force of discharge which lets paper out of a printer, should be imparted to a paper discharge part. The force of rotation of a convey roller in a paper convey part is transmitted to a paper discharge roller by means of a power transmission roller. As a result, the force of discharge acts on a sheet of paper printed put on the paper discharge roller. The outer surface of the paper discharge roller is made of rubber in order to enhance the force of friction with the paper. However, there is a limit to amicably deliver the paper with only the force of friction of the paper discharge roller. A separate auxiliary device is necessary for pressing paper on the paper discharge roller and for discharging it through an outlet formed in the housing of the printer. But there is a problem with such an auxiliary device in the form of a roller, which mates with the paper discharge roller. This because the paper on which a printed ink has not been completely dried up, reaches the paper discharge roller due to a short distance of 35–40 mm from where the paper was printed on by the ink cartridge thus the auxiliary device in the form of a roller is in contact with the paper on which the printed ink is not completely dried up so that there occurs poor printing due to the blurring of ink on the paper.

SUMMARY OF THE INVENTION

Accordingly, the present invention is directed to a paper discharge apparatus of a printer that substantially obviates one or more of the problems due to limitations and disadvantages of the related art.

An object of the present invention is to provide a paper discharge apparatus of a printer for amicably discharging paper by making the overlay quantity between a star wheel and a paper discharge roller uniform, and minimizing any deviation of multiple star wheels installed at equal intervals.

Another object of the present invention is to provide a paper discharge apparatus of a printer for preventing the blurring of ink by occupying broader space between the printed side of the discharged paper and the support portion of the star wheel.

Still another object of the present invention is to provide a paper discharge apparatus of a printer for amicably assembling the star wheel and controlling the size thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a paper discharge apparatus whose star wheel is installed in separate small injection molding, not in the large injection molding such as a cover door, and having sufficient paper discharge space between the printed side of the paper and the support rib for installing the star wheel.

Therefore, the paper discharge apparatus according to the present invention comprises a paper discharge roller for imparting the force of discharge to a sheet of paper printed, a star wheel for imparting the force of press required for the paper discharge at the upper portion of the paper discharge roller, a spring line whose both ends are fixed at a base frame by a fixing device, the spring line supporting the star wheel and functioning as a shaft which is able to make the star wheel rotate, and a wheel frame having a wheel location guide means, the wheel location guide means being fixed at the base frame for supporting the spring line at its regular location, and preventing the location movement of the star wheel.

Additionally, the paper discharge apparatus has a tension control means installed at a spring line fixing device for controlling the tension of the spring line, and a wheel location guide located at the upper portion of the spring line in order to occupy broader space of paper discharge, the wheel location guide mounted at a wheel frame.

It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the invention, and many of the attendant advantages thereof, will be readily apparent as the same becomes better understood by reference to the following detail description when considered in conjunction with the accompanying drawings in which like reference symbols indicate the same or similar components, wherein:

FIG. 1 roughly shows a cross-sectional view of an exemplary ink jet printer;

Figure 4:
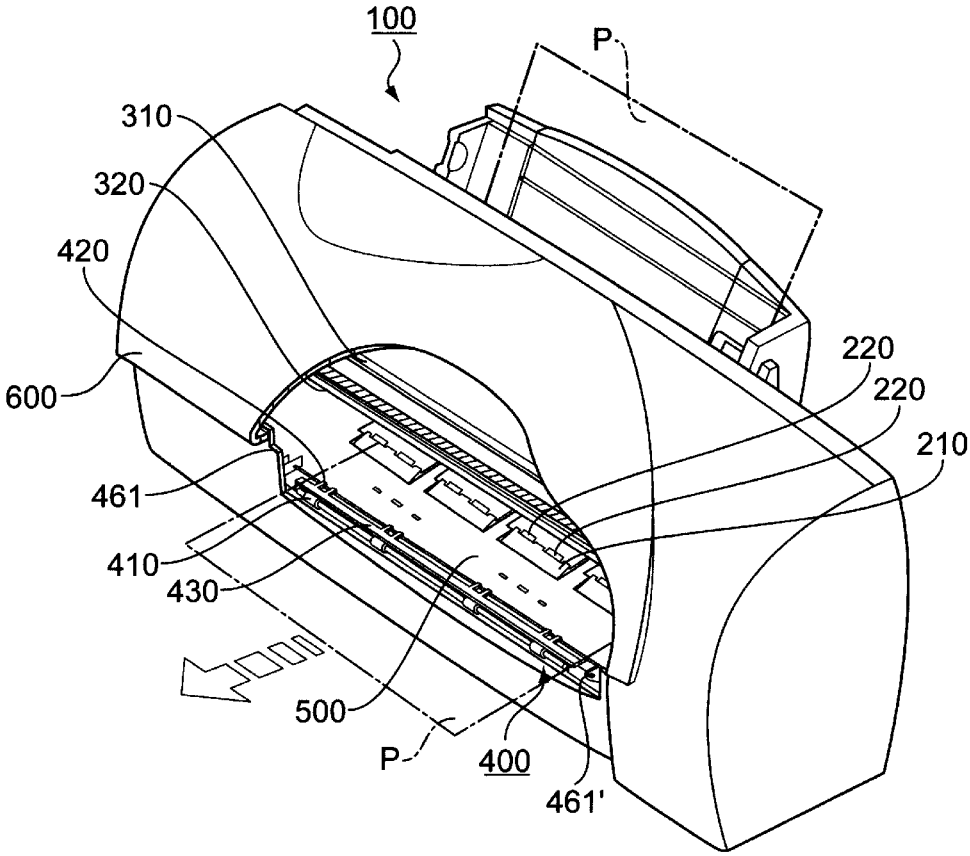
FIG. 4 is a partially cutaway perspective view of a preferred embodiment of a printer according to the principles of the present invention.
Figure 5:
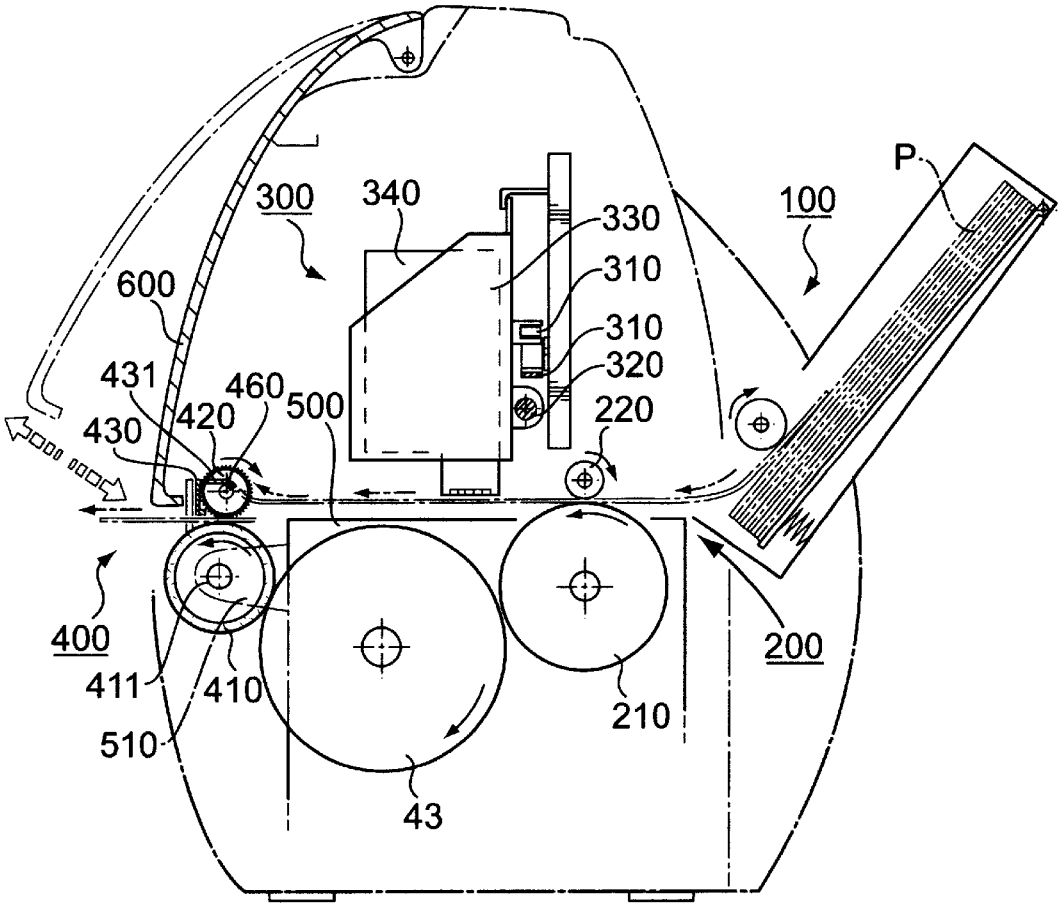
Figure 6:
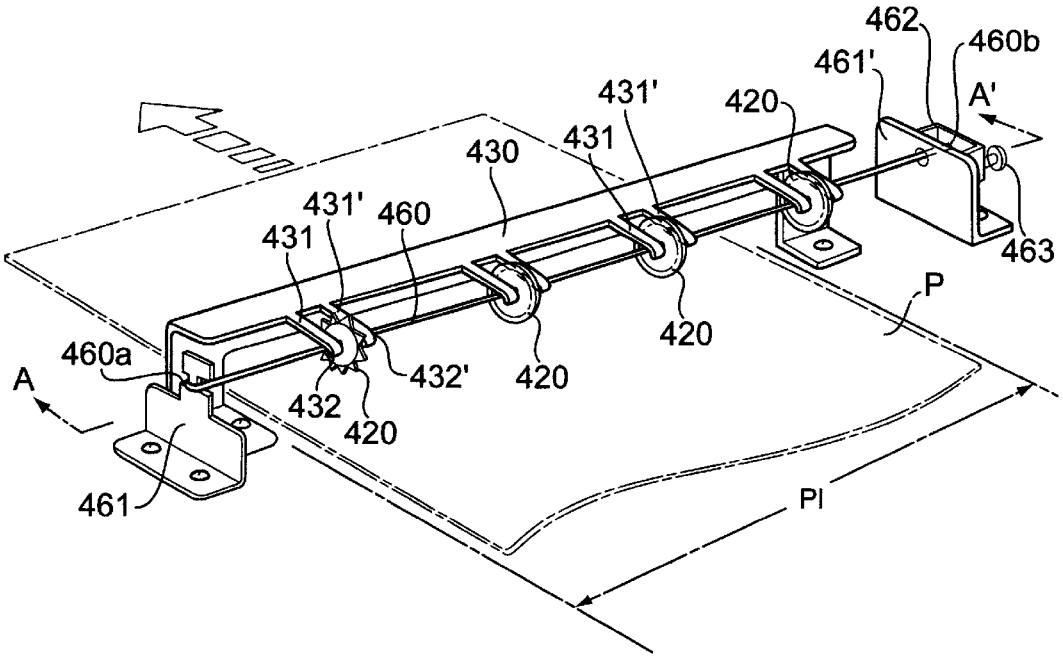
Figure 7:
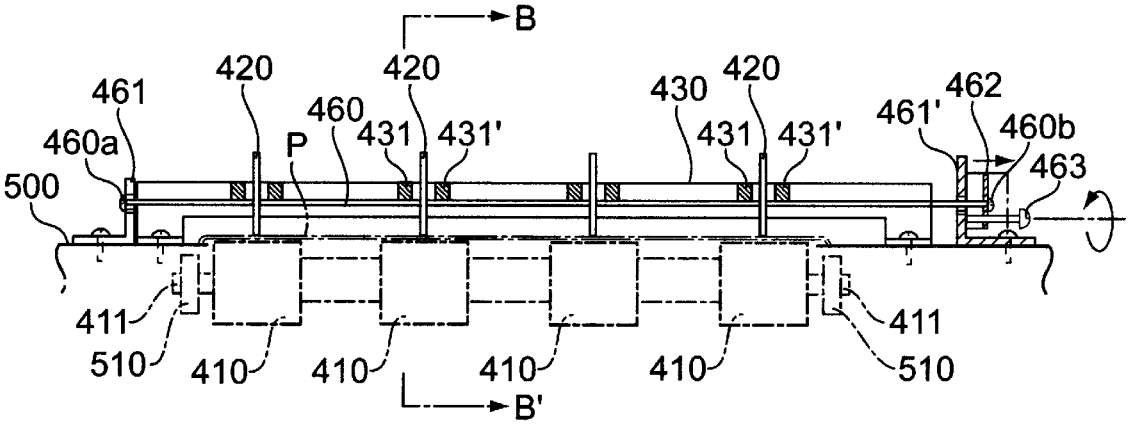
Figure 8:
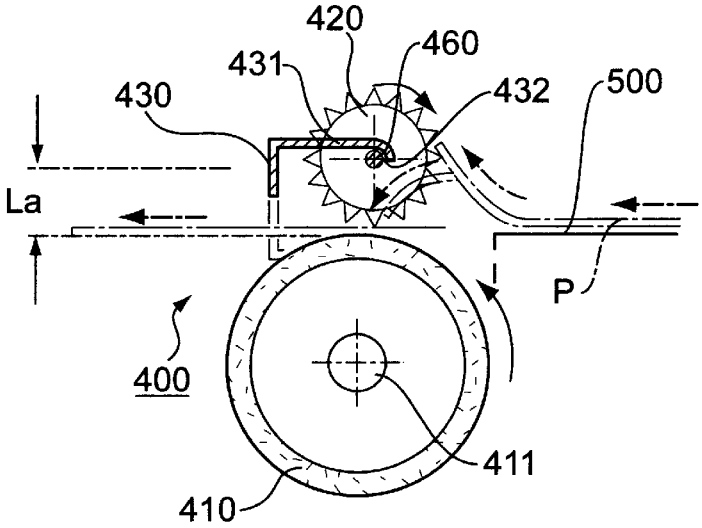

FIG. 5 roughly shows a cross-sectional structure of the printer shown in FIG. 4 according to the principles of the present invention;

FIG. 6 is a perspective view of an important portion of a paper discharge apparatus of the printer shown in FIG. 4 according to the principles of the present invention;

FIG. 7 is a cross-sectional view taken along the lines A-A' of FIG. 6; and FIG. 8 is a magnified cross-sectional view of an important portion taken along the lines B-B' of FIG. 7.

DETAILED DESCRIPTION OF PREFERRED EMBODIMENT

Figure 1:
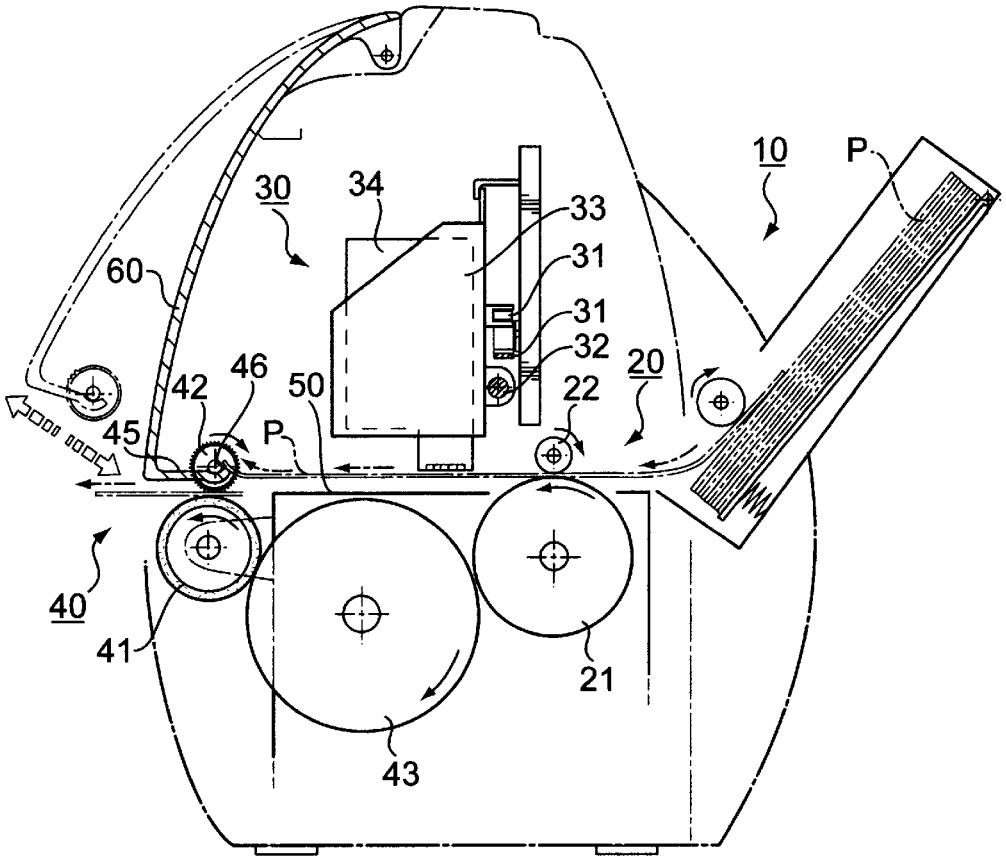
FIG. 1 (BACKGROUND ART)

As shown in FIG. 1, an exemplary ink-jet printer comprises a paper supply part 10 for supplying paper P one by one; a paper convey part 20 with a convey roller 21 and a friction roller 22 for conveying the paper P supplied by the paper supply part 10 in accordance with convey instructions; a print part 30 having a timing belt 31, a guide shaft 32, a carriage 33 moving right and left by the conveying force of the timing belt and the guidance of guide shaft 32 in order that an ink may be ejected and printed on paper P conveyed by paper convey part 20, and an ink cartridge 34 moving by carriage 33 for printing ink on paper P in accordance with print instructions; and a paper discharge part 40 with a paper discharge roller 41 and a star wheel 42 for discharging paper P printed on by print part 30.

Paper discharge part 40 will be described in detail hereinafter. Preferably, the discharge force which forces paper P out of a printer, should be imparted at paper discharge part 40. The force of rotation of convey roller 21 in paper convey part 20 is transmitted to paper discharge roller 41 by means of a power transmission roller 43. As a result, the discharge force acts on a sheet of paper printed P on paper discharge roller 41.

The outer surface of paper discharge roller 41 is made of rubber in order to enhance the force of friction with paper P. There is a limit, however, on favorably delivering paper P utilizing only the force of friction of paper discharge roller 41. A separate auxiliary device is necessary for pressing paper onto paper discharge roller 41 in order to ensure the paper is through an outlet formed in the printer housing. But there is a problem of such an auxiliary device when it is in the form of a roller which mates with paper discharge roller 41. This is because the paper on which ink was printed may not be completely dried by the time the printed paper reaches paper discharge roller 41 due to the short distance of 35–40 mm from where the paper was printed on by ink cartridge 34. Thus when the auxiliary device is in the form of a roller it remains in contact with the paper such that it may blur the ink on the paper.

Therefore, a star-shaped star wheel 42 with a plurality of saw teeth is employed to minimize the area of contact with the paper. A leading edge of paper P will come between the teeth of star wheel 42, thus star wheel 42 will force the paper to frictionally adhere to paper discharge roller 41 so that paper P is not raised upwards. Usually, the diameter of star wheel 42 is approximately half as large as that of paper discharge roller 41. As shown in FIG. 1, star wheel 42 is installed on a portion of cover door 60 which is injection molded, in order to easily get at and remove jammed paper.

Figure 2:
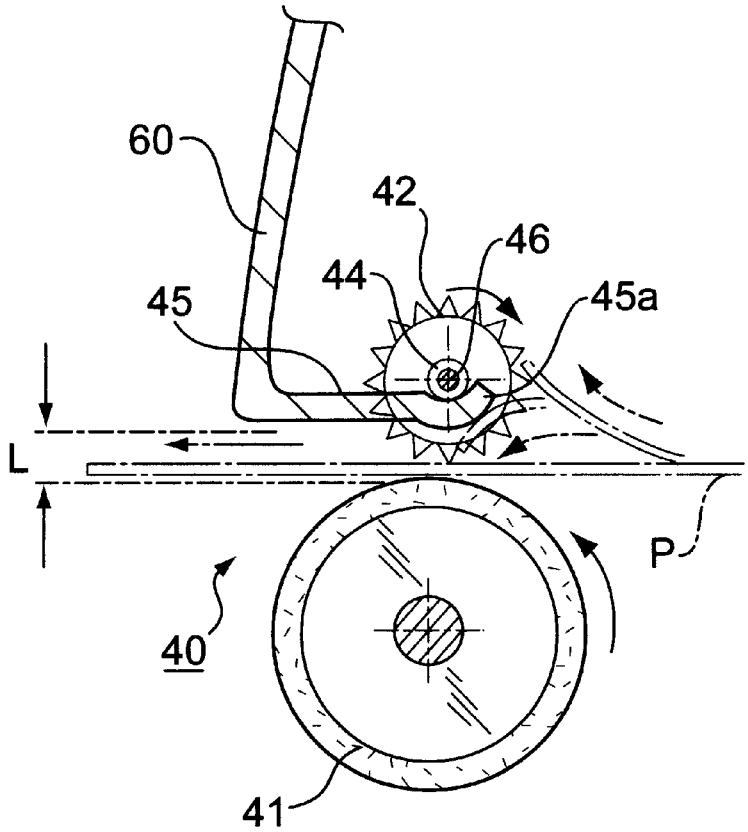
FIG. 2 (BACKGROUND ART)
FIG. 2 is a cross-sectional view of a paper discharge apparatus of the printer of FIG. 1.
Figure 3:
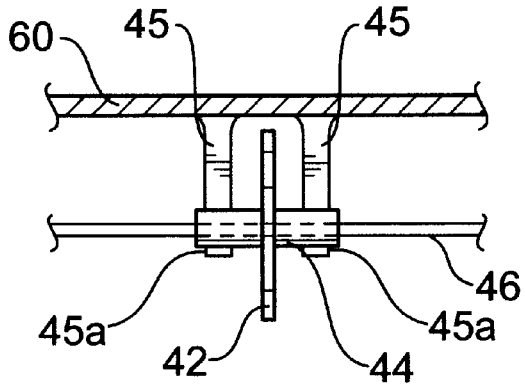
FIG. 3 (BACKGROUND ART)
FIG. 3 is a plan view of a star wheel for guiding paper to be discharged outside the ink jet printer of FIG. 1.

As shown in FIGS. 2 and 3, a wheel holder 44 is fixed in the center of star wheel 42, and put on a pair of door ribs 45 integrally formed in cover door 60. A spring line 46 has both ends fixed for tension and perforates the center of wheel holder 44, and curved supports 45*a* are located at the front end of door ribs 45, for enabling wheel holder 44 to be installed safely and for preventing wheel holder 44 from separating from door ribs 45. Door ribs 45 for supporting star wheel 42 are located toward the paper discharge roller 41, namely, under the center of star wheel 42 so that the discharge space L is formed in the paper discharging port below door ribs 45.

As shown in FIG. 2, the front end of the printed paper P curls upwards during the paper conveyance, it re-curls downwards because it gets caught by the teeth of star wheel 42, and then it is transmitted between star wheel 42 and paper discharge roller 41. Accordingly both sides of paper P which are not in contact with star wheel 42 contact curved supports 45*a* of both door ribs 45, thus door ribs 45 are stained with ink which is not completely dried up on paper P, and there is poor printing due to the blurring of ink on the paper. Also, the next paper may be stained with the ink on the door ribs 45.

The small-sized door ribs 45, integrally formed in the cover door 60 which is formed by a large-sized injection molding process, are the weakest portion in the large-sized injection molding so that it is hard to control the molding condition, and that the molding pressure provided in the molding field cannot reach to door ribs 45. Therefore, the curved supports 45*a* of the door ribs 45 are not well molded, and there is an irregularity in the curved supports 45*a*. As a result, there is frequent poor rotation of star wheel 42, and the paper is not properly discharged.

In addition, star wheel 42 and paper discharge roller 41 have a function while the cover door 60 at which the star wheel 42 is installed is connected to a front case so that it is hard to maintain the overlay quantity between star wheel 42 and paper discharge roller 41 by manufacture and assembly tolerance. There is a deviation of the overlay quantity between star wheel 42 distributed at the same interval and paper discharge roller 41. As a result, the paper is not amicably discharged.

FIGS. 4 to 8 illustrate a paper discharge apparatus of a printer according to the present invention. A printer as shown in FIGS. 4 and 5 comprises a paper supply part 100 for supplying sheets of paper P one by one; a paper convey part 200 with a convey roller 210 and a friction roller 220 for conveying paper P supplied by paper supply part 100 in accordance with convey instructions; a print part 300 having a timing belt 310, a guide shaft 320, a carriage 330 moving right and left by the conveying force of the timing belt and the guidance of the guide shaft in order that an ink may be ejected and printed on paper P conveyed by the paper convey part 200, and an ink cartridge 340 moved by carriage 330 for printing the ink on paper P in accordance with print instructions; and a paper discharge part 400 with a paper discharge roller 410 and a star wheel 420 for discharging paper P printed on by print part 300. A roller shaft 411 of the paper discharge roller 410 rotates in frame bosses 510 fixed at the front portion of a base frame 500. Star wheel 420 is positioned over paper discharge roller 410 and rotates while being inserted onto a spring line 460 installed in a pair of spring line frames 461 and 461' as shown in FIGS. 6 and 7. Spring line 460 forms the rotation shaft for star wheels 420.

Spring line frames 461 and 461' are constructed such that both ends 460*a* and 460*b* of the spring line 460 are fixed in spring line frames 461 and 461', and the tension of spring line 460 is controlled by a tension control device 463 and 463. Tension control device 462 and 463 are formed by a control bracket 462 to which end 460*b* of spring line 460 is attached. As control bracket 462 is moved by turning tension screw 463, spring line 460 fixed therein is pulled or loosened. As a result, the tension of the spring line 460 can be controlled.

Additionally, a wheel guide, made by injection molding, comprises a guide frame 430, multiple pairs of guide ribs 431 and 431' for establishing the height of spring line 460, and curved guide projections 432 and 432' located at the respective end portions of guide ribs 431 and 431'. Accordingly, the wheel guide prevents star wheels 420 from separating from its regular location by preventing spring line 460 from bending upwards. As shown in FIGS. 6 and 7, four star wheels 420 are distributed at regular intervals established by guide ribs 431 and 431' on guide frame 430. Also, guide frame 430 is fixedly attached to base frame 500 over paper discharge roller 410. Accordingly, star wheels 420 are installed in order not to separate from their regular location because of guide ribs 431 and 431' blocking them, and the spring line 460 having elasticity by tension is installed in order not to separate upwards and the discharged paper will not contact the guide ribs since the discharge spaces La between paper P discharged and guide ribs 431 and 431' become broader than the discharge space L in FIG. 2.

As shown in FIG. 8, therefore, the front end of the printed paper P curls during the paper conveyance to the base frame 500. However, during a process in which the paper is interrupted by the star wheel 420 and thus proceeds to the original discharge direction, the front end of the paper P does not contact guide ribs 431 and 431' so that there is no blurring of printed ink on the paper caused by guide ribs 431 and 431'.

Also, by lessening the tension on spring line 460 using tension screw 463, spring line 460 and star wheels 420 may be separated from the wheel guide to allow jammed paper to be easily removed. Therefore, the present invention provides a more reliable assembly tolerance control and maintains the ease of performing necessary maintenance.

According to the above explanation, the paper discharge apparatus of the present invention can maintain the size and eccentricity degree to the right and left direction of the paper discharge structure as designed. As a result, the paper is amicably discharged. Additionally, it can enhance the productivity due to the convenient assembly, and occupy broader space between the printed side of the discharged paper and the wheel location guide means for supporting the star wheel in order to prevent poor printing such as the blur of ink.

It will be apparent to those skilled in the art that various modifications and variations can be made in a paper discharge apparatus of a printer of the present invention without departing from the spirit or scope of the invention. Thus, it is intended that the present invention cover the modifications and variations of this invention provided they come within the scope of the appended claims and their equivalent.

What is claimed is:

1. A paper discharge apparatus for a printer, comprising:

a paper discharge roller for imparting a discharge force on a sheet of printed paper;

a star wheel positioned above said discharge roller for imparting a downward force on said printed paper for increasing a frictional force between said printed paper and said paper discharge roller;

first and second spring line frames fixedly attached to a frame of said printer;

a spring line forming a shaft about which said star wheel rotates, said spring line having one end thereof removably attached to said first spring line frame and a second end thereof fixedly attached to said second spring line frame; and a guide frame fixedly attached to said frame of said printer, said guide frame having wheel guide means positioned over and contacting an upper surface of said spring line and adjacent to said star wheel for preventing substantially any upward movement of said spring line and said star wheel.

2. The apparatus as set forth in claim 1, wherein said second spring line frame comprises tension control means for controlling the tension of said spring line.

3. The apparatus as set forth in claim 1, wherein said guide means comprises a pair of guide ribs, each guide rib of said pair of guide ribs being disposed on opposite sides of said star wheel wherein each of said guide ribs extends horizontally outward from and perpendicular to said guide frame wherein a distal end of each of said guide ribs forms curved guide projections overlapping a portion of said spring line.

4. The apparatus as set forth in claim 2, wherein said guide means comprises a pair of guide ribs, each guide rib of said pair of guide ribs being disposed on opposite sides of said star wheel wherein each of said guide ribs extends horizontally outward from and perpendicular to said guide frame wherein a distal end of each of said guide ribs forms curved guide projections overlapping a portion of said spring line.

5. The apparatus as set forth in claim 3, wherein said second spring line frame comprises tension control means for controlling the tension of said spring line.

6. The apparatus as claimed in claim 2, wherein said tension control means comprises:

a control bracket to which said second end of said spring line is fixed; and a tension control screw for moving said control bracket in order to increase or decrease tension in said spring line.

7. The apparatus as set forth in claim 1, wherein said guide frame is formed in a mold.

8. A paper discharge apparatus for a printer, comprising:

a paper discharge roller positioned adjacent to a discharge port of said printer for imparting a discharge force on a sheet of printed paper;

a plurality of star wheels positioned above said discharge roller for imparting a force on said printed paper in a direction towards said paper discharge roller for increasing a frictional force between said printed paper and said paper discharge roller;

first and second spring line frames fixedly attached to a frame of said printer;

a spring line forming a shaft about which said star wheels rotate, said spring line having one end thereof removably attached to said first spring line frame and a second end thereof fixedly attached to said spring line frame; and a guide frame fixedly attached to said frame of said printer, said guide frame having a plurality of wheel guide means positioned at predetermined intervals over and contacting an upper surface of said spring line for preventing substantially any upward movement of said spring line and said star wheels, each wheel guide means positioned adjacent to a corresponding one of said plurality of star wheels.

9. The apparatus as set forth in claim 8, wherein said second spring line frame comprises tension control means for controlling the tension of said spring line.

10. The apparatus as set forth in claim 8, wherein each of said wheel guide means comprises a pair of guide ribs, each guide rib of said pair of guide ribs being disposed on opposite sides of a respective one of said star wheels such that each of said guide ribs extends horizontally outward from and perpendicular to said guide frame and a distal end of each of said guide ribs forms a curved guide projection overlapping a portion of said spring line.

11. The apparatus as set forth in claim 9, wherein each of said wheel guide means comprises a pair of guide ribs, each guide rib of said pair of guide ribs being disposed on opposite sides of a respective one of said star wheels such that each of said guide ribs extends horizontally outward from and perpendicular to said guide frame and a distal end of each of said guide ribs forms a curved guide projection overlapping a portion of said spring line.

12. The apparatus as set forth in claim 10, wherein said second spring line frame comprises tension control means for controlling the tension of said spring line.

13. The apparatus as claimed in claim 9, wherein said tension control means comprises:

a control bracket to which said second end of said spring line is fixed; and a tension control screw for moving said control bracket in order to increase or decrease tension in said spring line.

14. The apparatus as set forth in claim 13, wherein said tension control screw is rotated to reduce the tension of said spring line to enable said first end of said spring line to be separated from said first spring line frame in order to provide access to said paper should said paper become jammed behind said star wheels.

15. A paper discharge apparatus for a printer, comprising:

a paper discharge roller for imparting a discharge force on a sheet of printed paper;

a star wheel for imparting a force on said printed paper for increasing a frictional force between said printed paper and said paper discharge roller;

first and second spring line frames fixedly attached to a frame of said printer;

a spring line forming a shaft about which said star wheel rotates, said spring line having one end thereof removably attached to said first spring line frame and a second end thereof fixedly attached to said second spring line frame, said second spring line frame comprising a tension control means for controlling the tension of said spring line, said tension control means comprising:

a control bracket to which said second end of said spring line is fixed; and a tension control screw for moving said control bracket in order to increase or decrease tension in said spring line; and a guide frame fixedly attached to said frame of said printer, said guide frame having wheel guides positioned over said spring line for preventing substantially any movement by said spring line and said star wheel in a direction opposite the direction of said force imparted on said printed paper.

16. The apparatus as set forth in claim 15, wherein said wheel guides comprise a pair of guide ribs, each guide rib of said pair of guide ribs being disposed on opposite sides of said star wheel wherein each of said guide ribs extends horizontally outward from and perpendicular to said guide frame wherein a distal end of each of said guide ribs forms curved guide projections overlapping a portion of said spring line.

* * * * *